US006506048B1

(12) United States Patent
Staffin et al.

(10) Patent No.: US 6,506,048 B1
(45) Date of Patent: Jan. 14, 2003

(54) APPARATUS AND METHOD FOR TRANSFERRING HEAT TREATED PARTS

(75) Inventors: H. Kenneth Staffin, Colonia, NJ (US); Marc Glasser, Warren, NJ (US); Karin Bickford, New York, NY (US); James Bickford, Pennington, NJ (US), legal representative

(73) Assignee: Procedyne Corp., New Brunswick, NJ (US)

( * ) Notice: Subject to any disclaimer, the term of this patent is extended or adjusted under 35 U.S.C. 154(b) by 0 days.

(21) Appl. No.: 10/016,186

(22) Filed: Nov. 1, 2001

(51) Int. Cl.[7] ..... F27B 15/02

(52) U.S. Cl. ..... 432/9; 432/15; 432/23; 432/262; 148/630

(58) Field of Search ..... 432/9, 15, 58, 432/23, 197, 215, 245, 262, 265; 110/245; 148/630, 710

(56) References Cited

U.S. PATENT DOCUMENTS

| | | | | | |
|---|---|---|---|---|---|
| 2,835,483 | A | * | 5/1958 | Lindsay | 122/23 |
| 3,053,704 | A | | 9/1962 | Munday | 148/20.3 |
| 3,677,404 | A | | 7/1972 | Staffin | 210/67 |
| 4,340,433 | A | | 7/1982 | Harding | 148/16 |
| 4,461,656 | A | * | 7/1984 | Ross | 148/209 |
| 4,512,821 | A | | 4/1985 | Staffin et al. | 148/16.5 |
| 5,399,207 | A | | 3/1995 | Kemp | 148/209 |
| 5,423,370 | A | * | 6/1995 | Bonnemasou et al. | 164/132 |
| 5,620,521 | A | * | 4/1997 | Tachikawa et al. | 118/717 |
| 6,147,328 | A | | 11/2000 | Loser et al. | 219/388 |

* cited by examiner

*Primary Examiner*—Gregory Wilson
(74) *Attorney, Agent, or Firm*—Pitney, Hardin, Kipp & Szuch LLP

(57) ABSTRACT

A parts container for minimizing oxidation of heat-treated parts during transfer in an oxygen-containing environment. The container includes: a heat-resistant vessel having an interior space and including oppositely positioned first and second apertures; a heat-resistant, porous support element fluidly connected to the first aperture to provide a bottom to for the vessel; and a disposed in the interior space a plurality of fluidizable granular solids and at least one heat-treatment part. The fluidizable granular solids provide a transient protective environment for the parts after heat treatment thereby minimizing exposure of the parts to oxygen in the surrounding environment. Additional embodiments and methods of use are also described.

17 Claims, 2 Drawing Sheets

APPARATUS AND METHOD FOR TRANSFERRING HEAT TREATED PARTS

BACKGROUND OF THE INVENTION

1. Field of the Invention

The present invention relates to the field of heat treating of parts, and in particular, to a transfer vessel to minimize unwanted oxidation of heat-treated parts during fluid bed heat treating and subsequent quenching.

2. Description of Related Art

Processes for improving the physical characteristics of metal parts (e.g., castings, forgings and the like) that require a controlled temperature experience of the parts and sometimes require controlled furnace atmospheres, are well-known and are referred to collectively as "Metal Treatment Processes." Examples of these processes include carburizing, carbonitriding, case hardening, through hardening, carbon restoration, normalizing, stress relieving, annealing, among others.

Generally, these processes involve exposing a metal part to elevated temperatures in a furnace having a controlled atmosphere that either alters or maintains the chemical composition of the part. Following a heating experience in the furnace, the part is typically cooled in a quench medium to achieve the desired physical properties.

Fluidized bed furnaces are well known in the metal treatment arts for their advantages of rapid and uniform heat transfer, ease of use and safety. Examples of the use of fluidized bed furnaces for metal treatment processes are illustrated in U.S. Pat. Nos. 3,053,704 and 4,512,821. Metal treatment with a fluid bed furnace is often followed by fluid bed quench.

As known to those skilled in the art, a fluidized bed consists of a mass of finely divided particles contained in a chamber through which a gas is passed through a multiplicity of ports in the bottom of the chamber. If the velocity of the gas entering the bed is properly adjusted, the particles are separated and levitated and move about in a random manner such that the entire bed of levitated particles resembles a liquid phase in behavior. Such apparatuses are well known and their fundamental behavior has numerous applications. A typical bed is disclosed in U.S. Pat. Nos. 3,677,404 and 4,512,821 owned by the assignee of the present application and are incorporated herein by reference. In a typical configuration, the fluidizing gas enters a plenum chamber generally co-extensive with the bottom horizontal extent of the bed and directs the fluidizing gas through the ports. The gas rises through the bed during which the liquid-like behavior is imparted to the particulate medium.

However, a problem with a number of metal treatment processes is that when the metal parts are removed from the furnace environment at an elevated temperature, the surface of the parts must be protected from contact with another atmosphere, such as air, until the part is cooled below a maximum temperature, typically in a quench or cooling bath. For example, if the surface of the parts is degraded by oxidation when contacted with air at elevated temperature, it is necessary to protect the parts from this contact until the temperature of the parts can be reduced. This is especially problematic when transferring parts from the furnace to quench.

To accomplish transfer without the parts contacting oxygen, it is typically necessary to build a sealed enclosure over the top of the fluid bed furnace, the transfer mechanism, and the top of the fluidized bed quench vessel, to exclude the presence of oxygen. This enclosure is typically purged with oxygen-free gas to exclude air from the furnace and/or the quench vessel.

Another approach to minimize oxidation during transfer is to employ a mobile transfer vessel, which is first positioned and sealed above the loading aperture at the top of the furnace. The parts load is lifted vertically out of the fluid bed furnace into the mobile transfer vessel. The transfer vessel is equipped with a slide-gate door at the bottom, which is then closed. The transfer vessel is then moved to the quench or cooling fluid bed which is also fluidized with a gas phase that does not contain oxygen. The slide-gate door is then opened at the bottom of the transfer vessel and the parts load is lowered into the quench or cooling fluid bed. The parts are removed after being cooled to a temperature sufficiently low that they no longer require protection from an oxygen-containing atmosphere. These enclosures are frequently cumbersome from an operating point-of-view and significantly increase the capital cost of the heat-treating furnace and quench system.

Thus, there is a need in the art for simple and non-capital intensive method of protecting metal parts from oxidation during transfer from furnace to quench. Accordingly, it is an object of the present invention to provide such a method and apparatus for use in such a method.

SUMMARY OF THE INVENTION

The present invention provides a parts container for minimizing oxidation of heat-treated parts. The container includes: a heat-resistant vessel having an interior space and including oppositely positioned first and second apertures; a heat-resistant, porous support element fluidly connected to the first aperture thereby providing a bottom for the vessel; and disposed in the interior space a plurality of fluidizable granular solids and at least one heat-treatable part. The parts container can additionally include a conduit fluidly connected to the porous support element to facilitate movement of fluidizing gas into the interior space of the vessel. Likewise, the parts container can also include a second heat-resistant porous support element fluidly connected to the second aperture to provide a top for the vessel. Preferably, vessel of the parts container is a cylindrical body and is of metal. The first and second porous support elements are preferably heat-resistant screens. In another preferred embodiment, the interior space of the vessel includes a plurality of heat-treatable parts dispersed in the plurality of fluidizable granular solids. The heat-treatable part is preferably of metal. In another embodiment, the plurality of fluidizable granular solids are reactive with the heat-treatable part.

A method of minimizing oxidation during the transfer of heat-treated parts is also provided. The methods includes: providing a fluid bed furnace having a chamber for receipt of parts to be heat-treated; providing the above-described parts container; submerging the parts container into the chamber of the fluid bed furnace where fluidizing gas enters the parts container through the porous support element thus fluidizing the plurality of granular solids. Preferably, the method further includes the step of removing the parts container from the chamber thus defluidizing the plurality of granular solids in the interior space of the vessel, where the heat-treatable part becomes submerged in the defluidized granular solids. In a more preferred embodiment, the method further includes the step of transferring the parts container from the fluid bed furnace to a fluid bed quench, and includes the step of submerging the parts container in the fluid quench.

Advantageously, the apparatus and method of the present invention inhibit oxidation of heat-treated parts during transfer in an oxygen-containing environment without resort to sealed enclosures and sealed transfer vessels as presently used in the art. These and other advantages of the invention will become more readily apparent from the description set forth below.

DETAILED DESCRIPTION OF THE INVENTION

The present invention provides an apparatus and method for minimizing oxidation and other unwanted reactions of heat-treated parts during transfer from a fluid bed furnace. As described above, heat-treated parts once removed from the chamber of a fluid bed furnace are susceptible to oxidation due to oxygen in the atmosphere. In accordance with the invention, oxidation of a heat-treatable part due to exposure to an oxidizing environment (e.g., normal atmosphere) is minimized with a parts container that includes (1) a heat-resistant vessel having an interior space and including oppositely positioned first and second apertures; (2) a heat-resistant, porous support element fluidly connected to said first aperture which provides a bottom for the vessel; and (3) disposed in the interior space of the vessel a plurality of fluidizable granular solids and at least one heat-treatable part where the part is preferably dispersed within the plurality of fluidizable granular solids.

Figure 1:
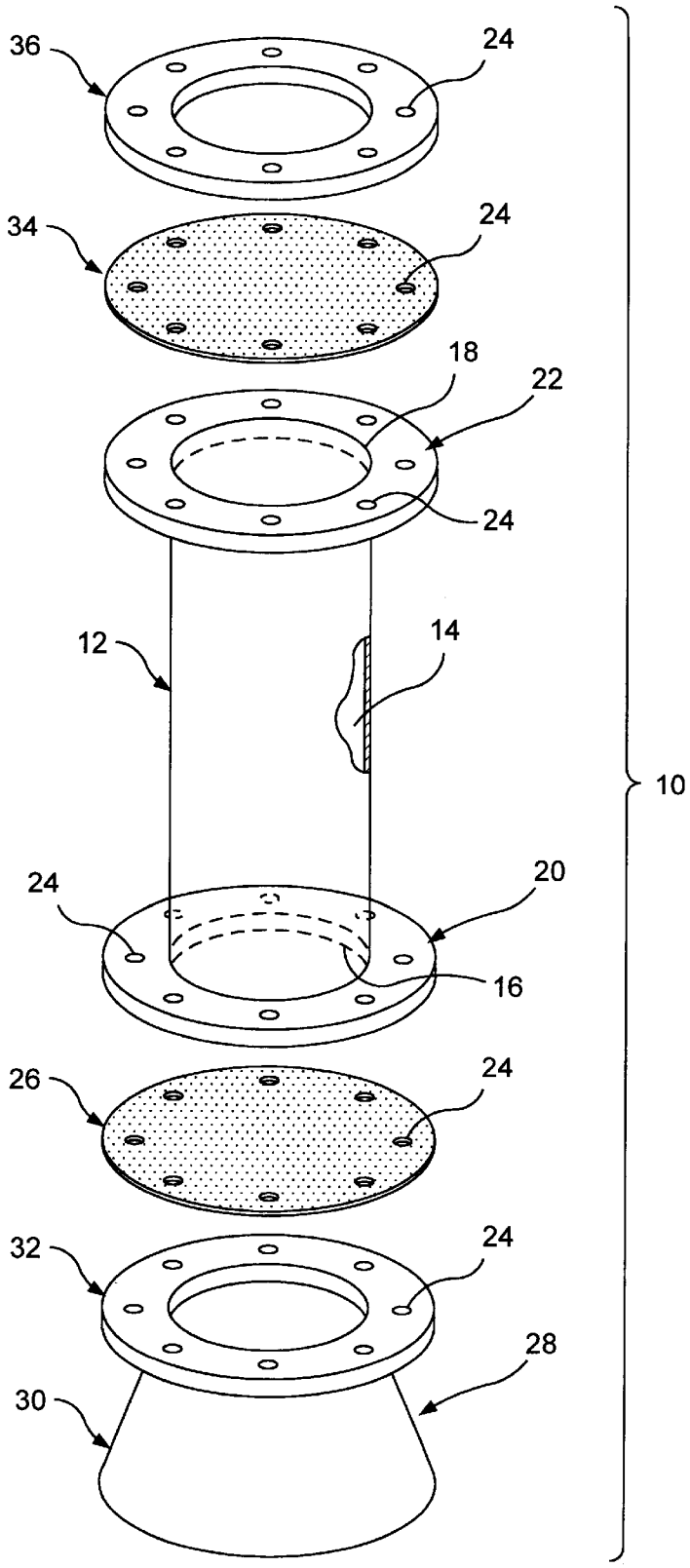
FIG. 1 is an exploded view of a preferred embodiment of the parts container of the present invention.

Referring to FIG. 1, a parts container 10 is provided including a heat-resistant vessel 12 having an interior space 14. In a more preferred embodiment, vessel 12 is a cylindrical body. Vessel 12 further includes a first aperture 16 and a second aperture 18 positioned in an opposing orientation (i.e., at opposite ends of vessel 12). Optionally, vessel 12 includes bolting flanges 20 and 22 circumscribing the first and second apertures 16 and 18, respectively. As illustrated in FIG. 1, flanges 20 and 22 optionally include boltholes 24. Reference to the term "heat-resistant" means that the material is capable of withstanding the elevated temperatures commonly found fluid bed furnaces used for heat-treating parts. Examples of heat-resistant materials (e.g., metals and metal alloys) to be used in accordance with the invention are well known in the art. In a more preferred embodiment, vessel 12 is made of heat-resistant metal or a metal alloy.

In accordance with the invention, a heat-resistant porous support element 26 is fluidly connected to the first aperture 16 of vessel 12 to provide a bottom for vessel 12. As shown in FIG. 1, porous support element 26 may optionally include boltholes 24 to connect porous support element 26 to vessel 12 via flange 20. However, as will be apparent to those skilled in the art, porous support element 26 can be fluidly connected to vessel 12 by any means known in the art. Preferably, porous support element 26 is connected to vessel 12 in such manner that porous support element 26 is removable. In a preferred embodiment, porous support element 26 is a heat-resistant screen. Porous support element 26 has a porosity (or in the case of a screen a mesh size) less than the fluidizable granular solids to maintain the solids within interior space 14 of vessel 12 while allowing the movement of fluidizing gas in and out of the vessel. As will be to those skilled in the art, other structures such as a perforated metal plate can also be utilized as a porous support element in accordance with invention.

In a more preferred embodiment, as shown in FIG. 1, conduit 28 is fluidly connected to porous support element 26 to facilitate funnel-like movement of fluidizing gas into the interior space 14 of vessel 12. Conduit 28 preferably includes fastening flange 32 (with optional boltholes 24) integral with a hollowed frustoconical structure 30 such that the conduit provides a funnel-like movement of fluidizing gas into vessel 12 through porous support element 26. Conduit 28 is optionally mechanically attachable to vessel 12 by bolting through boltholes 24 such that porous support element 26 is positioned between conduit 28 and vessel 12.

Likewise, in a more preferred embodiment, as shown in FIG. 1, a second heat-resistant porous support element 34 is fluidly connected to the second aperture 18 of vessel 12 to provide a top for vessel 12. Porous support element 34 additionally provides a barrier to the egress of granular solids disposed in interior space 14 out of vessel 12 and a barrier to the ingress of granular solids from the fluid bed chamber into vessel 12. Porous support element 34 also provides a barrier to the egress of parts disposed in the interior of vessel 12 if the parts to be heat-treated are of such a low density as to permit their egress. Porous support element 34 is removable to facilitate loading of interior space 14.

Figure 2:
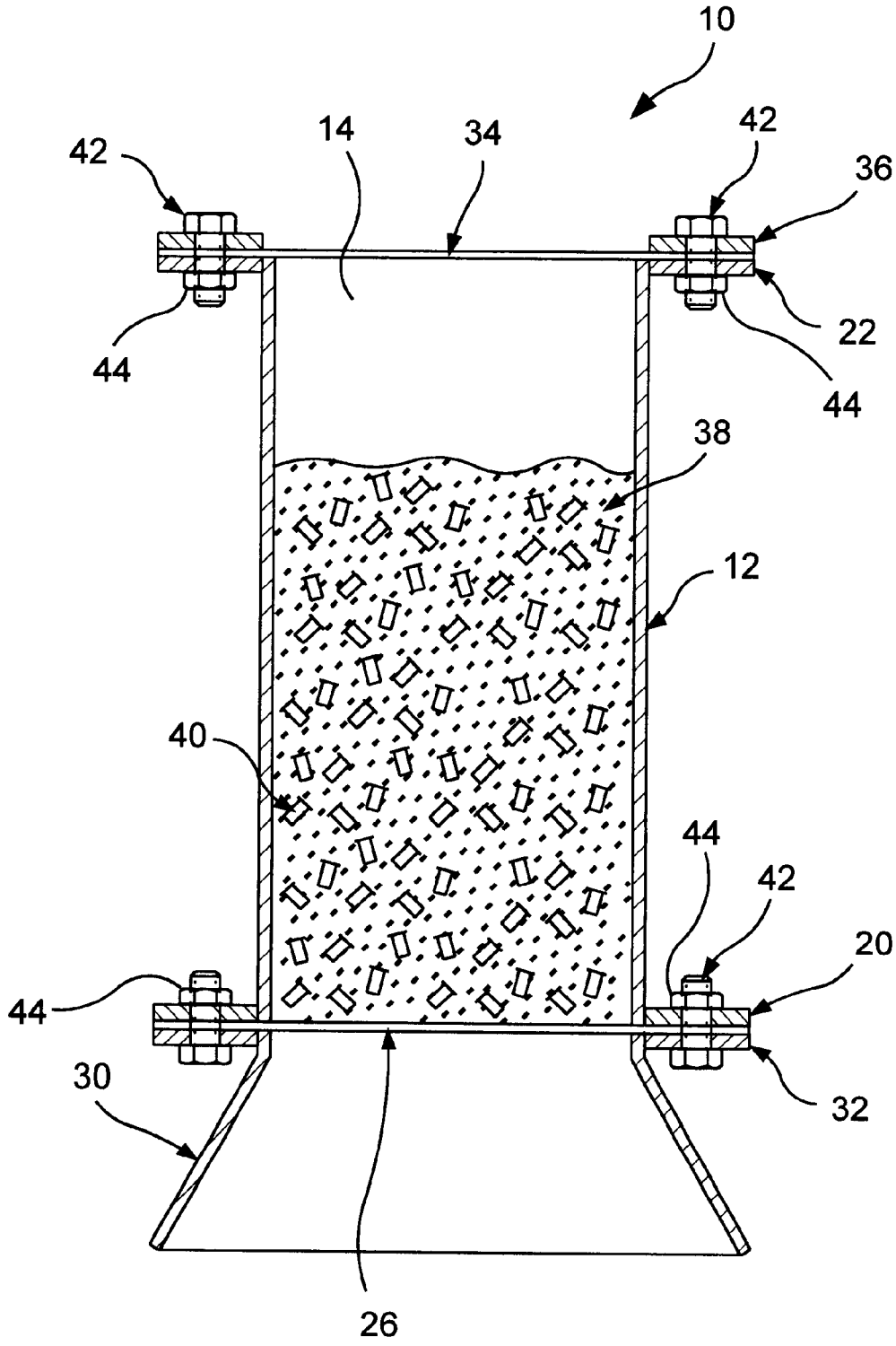
FIG. 2 is a cross-sectional view of the assembled parts container in FIG. 1 containing parts to be heat-treated and fluidizable granular solids in an unfluidized state.

Referring to FIG. 2, a cross-section of the assembled parts container 10 is provided. Parts container 10 includes vessel 12 having interior space 14 partially filled with fluidizable granular solids 38 preferably having dispersed therein a plurality of heat-treatable parts 40. Preferably, interior space 14 is filled (i.e., loaded) with fluidizable granular solids 38 and heat-treatable parts 40 to occupy up to about 60 volume percent of interior space 14. The particular level of fill can be higher or lower depending upon the fluidization characteristics of granular solids 38 and heat-treatable parts 40. However, since the level of the fluidized solids is always greater than defluidized solids due the volume occupied by the flowing fluidizing gas, sufficient space for expansion should be provided between porous support element 34, if utilized, and parts 40 and granular solids 38. The volumetric ratio of granular solids 38 to parts 40 is preferably about 1:2, with 2:3 being more preferred, and a 1:1 ratio being even more preferred. However, as will be apparent to those skilled in the art, the particular ratio will be dependent upon the shape of parts 40 and the fluidization characteristics of granular solids 38 and heat-treatable parts 40. Preferably, a layer of granular solids 38 (absent parts 40) is provided within interior 14 at a position proximal to aperture 18 to facilitate parts 40 being submerged (i.e., substantially buried) in granular solids 38 after defluidization. In accordance with the invention, granular solids 38 are the same as or different from the granular solids used as the fluidizing medium in the fluid bed furnace and the subsequent fluid bed quench. Preferably, granular solids 38 are identical to those being used as the fluidizing medium and are thus non-reactive with parts 40. Granular solids to be used are preferably poor heat conductors (i.e., act as insulators). In another embodiment, the granular solids 38 are reactive with heat-treatable parts 40 to effect various chemical treatments as known in the art. Any variety of parts in which heat-treatment is desirable can be treated using parts container 10. In one embodiment, heat-treatable parts 40 are of metal or of a metal alloy.

As shown in FIG. 2, vessel 12 is provided with a bottom by connecting porous support element 26 to bolting flange 20 with fastening flange 32 of conduit 28. Bolting flange 20, porous support element 26 and fastening flange 36 are connected in a sandwich arrangement, respectively, through boltholes 24 (not shown) with bolts 44 and nuts 42. Likewise, vessel 12 is provided with a top using porous support element 34 after interior space 14 is loaded with granular solids 38 and parts 40. Bolting flange 22, porous support element 34 and fastening flange 36 are connected in a sandwich arrangement, respectively, through boltholes 24 (not shown) with bolts 44 and nuts 42.

As previously described, the present invention provides a method of minimizing oxidation of heat-treated parts using the parts container of the invention. This is accomplished by submerging the assembled parts container 10, as shown in its preferred embodiment in FIG. 2, into a chamber of a fluid bed furnace that is adapted for heat-treating parts. Such furnaces are well known in the art. Part container 10 is submerged by lowering the container into the fluid furnace using any suitable means such as a hoist. As parts container 10 is submerged into the furnace, fluidizing gas enters interior space 14 through porous support element 26 thus fluidizing the plurality of granular solids 38 and exiting through second porous support element 34. During submergence, movement of the fluidizing gas through porous support element 26 is facilitated by frustoconical structure 30 of conduit 28, which further directs the fluidizing gas in a funnel-like fashion. As the parts container 10 is submerged further into the chamber of the fluid bed furnace, the gas phase pressure increases thereby increasing the flow rate of the gas phase through parts container 10. The granular solids 38 in parts container 10 become fluidized when the flow rate of gas reaches minimum fluidization velocity, thus creating a fluidized bed within parts container 10 which surrounds parts 40 while parts container 10 itself is surrounded on the outside by the fluidized bed of the fluid bed furnace. While not wishing to be limited by theory, it is believed that due to the excellent heat transfer coefficients and temperature uniformity exhibited by the fluidized solids of the furnace, heat is rapidly and uniformly transferred from the fluid bed furnace through the wall of the vessel 12 to the fluidized granular solids 38 and parts 40 being heat treated. The temperature and time parameters in which parts container 10 is submerged is dependent on the heat treatment process being effected. These parameters can easily be ascertained by one skilled in the art.

At the conclusion of the heat treatment cycle, parts container 10 is withdrawn (i.e., removed) from the fluid bed furnace using any suitable means (e.g., a hoist). As parts container 10 is withdrawn from the fluid bed furnace, parts 40 become surrounded by (i.e., buried under) defluidized granular solids 38 which in turn temporarily provides a protective environment from atmospheric air. While not wishing to be limited by theory, as parts container 10 is being withdrawn from the chamber of the fluid bed furnace, the gas phase pressure decreases resulting in a decreased flow of fluidizing gas in the parts container 10. Defluidization occurs once porous support element 26 clears the chamber of the fluid bed furnace resulting in granular solids 38 in parts container 10 forming a surrounding relationship with parts 40. The surrounding relationship further minimizes contact with the atmospheric air in addition to minimizing heat loss from parts 40 due to the insulating properties of granular solids 38.

In a more preferred embodiment, parts container 10 is transferred to a fluid bed quench after being removed from the fluid bed furnace. Transfer mechanisms and fluid bed quenchers to be used in accordance with the invention are well known in the art. Advantageously, transfer is effected without a sealed enclosure or sealed transfer vessel as commonly used in the art. Thus, parts container 10 can be exposed to an oxygen-containing environment after removal from the fluid bed furnace and during transfer to the fluid quench. Part container 10 is then submerged in the fluid bed quench whereby granular solids 38 are fluidized in the manner described above for the fluid bed furnace. At a minimum, the fluidizing gas of the fluid bed quench is oxygen-free to avoid oxidation of parts 40 and preferably is the same as used in the fluid bed furnace. After the temperature of the parts is rapidly reduced in the fluid bed quench, parts container 10 is removed and granular solids 38 are defluidized in the above-described manner. Parts container 10 is partially or completely disassembled to remove parts 40 for subsequent processing.

What is claimed is:

1. A parts container for minimizing oxidation of heat-treated parts, said container comprising:

a heat-resistant vessel having an interior space and including oppositely positioned first and second apertures;

a heat-resistant, porous support element fluidly connected to said first aperture thereby providing a bottom to said vessel; and disposed in said interior space a plurality of fluidizable granular solids and at least one heat-treatable part.

2. The parts container of claim 1, further comprising a conduit fluidly connected to said porous support element to facilitate movement of fluidizing gas into said interior space of said vessel.

3. The parts container of claim 1, further comprising a second heat-resistant porous support element fluidly connected to said second aperture thereby providing a top for said vessel.

4. The parts container of claim 3, wherein said porous support element is a heat-resistant screen.

5. The parts container of claim 1, wherein said vessel is a cylindrical body.

6. The parts container of claim 1, wherein said porous support element is a heat-resistant screen.

7. The parts container of claim 1, wherein said interior space includes a plurality of heat-treatable parts dispersed in said plurality of fluidizable granular solids.

8. The parts container of claim 1, wherein said vessel comprises metal.

9. The parts container of claim 1, wherein said heat-treatable part comprises metal.

10. The parts container of claim 1, wherein said plurality of fluidizable granular solids are reactive with said heat-treatable part.

11. A method of minimizing oxidation during the transfer of heat-treated parts, which comprises:

providing a fluid bed furnace having a chamber for receipt parts to be heat-treated;

providing a parts container which includes:

a heat-resistant vessel having an interior space and including oppositely positioned first and second apertures;

a heat-resistant, porous support element fluidly connected to said first aperture thereby providing a bottom to said vessel; and disposed in said interior space a plurality of fluidizable granular solids and at least one heat-treatable part; and submerging said parts container into said chamber of said fluid bed furnace whereby fluidizing gas enters said parts container through said porous support element fluidizing said plurality of granular solids.

12. The method of claim 11, further comprising the step of removing said parts container from said chamber thereby defluidizing said plurality of granular solids in said interior space of said vessel, wherein said heat-treatable part is dispersed in said defluidized granular solids.

13. The method of claim 11, further comprising the step of transferring said parts container from said fluid bed furnace to a fluid bed quench.

14. The method of claim 13, further comprising the step of submerging said parts container in a fluid quench.

15. The method of claim 11, wherein said parts container further comprises a second heat-resistant porous support element fluidly connected to said second aperture thereby providing a top for said vessel.

16. The method of claim 11, wherein said parts container further comprises a conduit fluidly connected to said porous support element to facilitate movement of fluidizing gas into said interior space of said vessel.

17. The method of claim 11, wherein said interior space includes a plurality of heat-treatable parts dispersed in said plurality of fluidizable granular solids.

* * * * *